US007692526B2

(12) United States Patent
Hundt

(10) Patent No.: US 7,692,526 B2
(45) Date of Patent: Apr. 6, 2010

(54) INDUCTIVE COMPONENT AND METHOD FOR THE MANUFACTURE OF SUCH A COMPONENT

(75) Inventor: Harald Hundt, Dieburg (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 170 days.

(21) Appl. No.: 11/752,581

(22) Filed: May 23, 2007

(65) Prior Publication Data

US 2008/0048815 A1 Feb. 28, 2008

Related U.S. Application Data

(63) Continuation of application No. PCT/EP2005/012850, filed on Dec. 1, 2005.

(30) Foreign Application Priority Data

Dec. 3, 2004 (DE) ..... 10 2004 058 452

(51) Int. Cl.
*H01F 27/29* (2006.01)

(52) U.S. Cl. ..... 336/192

(58) Field of Classification Search ..... 336/65, 336/83, 192, 198, 229, 107
See application file for complete search history.

(56) References Cited

U.S. PATENT DOCUMENTS

| | | | | |
|---|---|---|---|---|
| 2,246,167 A * | 6/1941 | D'Entremont | ..... | 336/182 |
| 4,491,818 A | 1/1985 | Danenberg et al. | ..... | 336/65 |
| 5,030,520 A | 7/1991 | Olper et al. | ..... | 428/660 |
| 5,107,204 A | 4/1992 | Bullock et al. | ..... | 324/127 |
| 5,343,143 A | 8/1994 | Voisine et al. | ..... | 324/142 |
| 7,460,002 B2 * | 12/2008 | Estrov | ..... | 336/200 |
| 2002/0190832 A1 | 12/2002 | Amada et al. | ..... | 336/192 |
| 2006/0054184 A1 | 3/2006 | Mozetic et al. | ..... | 134/1.1 |

FOREIGN PATENT DOCUMENTS

| | | |
|---|---|---|
| CH | 674678 | 12/1987 |
| DE | 1765754 | 7/1968 |
| DE | 2927348 | 7/1979 |
| DE | 68927122 | 2/1989 |

(Continued)

OTHER PUBLICATIONS

First Notice Informing The Applicant of the Communication of The International Application; PCT/EP2005/012850; pp. 7, Date of Mailing: Jul. 6, 2006.

(Continued)

*Primary Examiner*—Tuyen Nguyen
(74) *Attorney, Agent, or Firm*—King & Spalding L.L.P.

(57) ABSTRACT

An inductive component (0) has a conductor (1) with a non-rectangular cross section and is used for conducting a current, and at least one planar terminal lead (4) for feeding or discharging the current to or from the conductor (1). The conductor (1) and the terminal lead (4) are interconnected in the area of a joining section (3) of the conductor (1) so as to form a conductor arrangement. The conductor (1) is provided with a flat cross section in the area of the joining section (3) while a flat area of the joining section (3) of the conductor (1) is connected to a flat area of the terminal lead (4).

20 Claims, 4 Drawing Sheets

FOREIGN PATENT DOCUMENTS

| | | |
|---|---|---|
| DE | 10105416 | 1/2001 |
| EP | 0389678 | 11/1989 |
| EP | 0803732 | 10/1997 |
| GB | 1222124 | 5/1968 |
| GB | 1278698 | 7/1969 |
| GB | 2026175 | 7/1979 |
| JP | 53081470 | 7/1978 |
| JP | 9226579 | 2/1997 |
| WO | 03/013759 | 2/2003 |
| WO | 2004/098259 | 11/2004 |

OTHER PUBLICATIONS

"Fuegetechnik, Schweisstechnik", DVS-Vertag, ISBN 3-87155-786-2, 3 pages, 2004.

* cited by examiner

INDUCTIVE COMPONENT AND METHOD FOR THE MANUFACTURE OF SUCH A COMPONENT

CROSS-REFERENCE TO RELATED APPLICATION

This application is a continuation of co-pending International Application No. PCT/EP2005/012850 filed Dec. 1, 2005, which designates the United States, and claims priority to German application number DE 10 2004 058 452.4 filed Dec. 3, 2004.

TECHNICAL FIELD

The invention relates to an inductive component with a conductor with a non-rectangular cross-section for the conductivity of a current. The invention relates in particular to an inductive component with a magnetic module with an opening, whereby the conductor is led through the opening. The invention also relates to a method for the setting up of a structured order of conductors for such an inductive component.

BACKGROUND

Various electronic power counters are known for the purposes of current collection, which are increasingly replacing the mechanical Ferraris disc meter in industrial as well as household usage, and carry out the current collection with differently structured order structures. Along with current collection with mess shunts, Rogowski solenoids or Hall elements, current transformers based on soft magnetic ring cores, in particular ring band cores as magnetic modules in electronic counters are also widely used. A magnetic module (current transformer, transformers) causes a galvanic network separation and delivers a precise measurement size in the form of a signal voltage at a load resistor. The requirements of exactness of amplitude, exactness of phases and linearity are fixed through IEC 62053, -21, -23 and/or earlier 1036 in Europe as well as ANSI C12.xx in the USA, and are to be found for example in the prospectus of the firm "VAC current transformers for electronic energy meters", of the vacuum smelter, Oct. 1998. Current transformers for electronic energy meters are generally also well known from the prospectus of the firm "Current transformers for electronic energy meters" of the vacuum smelter, 2002. Such energy meters using current transformers (also known as watt-hour meters) serve as officially authorized means of measurement, in order to settle the cost of the electric current used by a consumer vis-à-vis the energy providing concern.

Well known are a structure of current bars and a ring core current transformer corresponding to it for the collection of consumer electricity consumption in energy meters. In pluggable electricity meters widespread in the USA and other countries there are standardized rectangular terminal lugs on the reverse, which are plugged into plug points with corresponding spring contacts at the time of assembly of the electricity meter. These lugs with a cross-section of approx. a×2.5 mm serve to supply and discharge the consumer current, which amounts in the 110 V systems to a maximum of approx. 200-480 $A_{eff}$. As thickness 'a' of the cross-section for example a=19 mm is set at a maximum current of I-max=320 A. Normally the currents of the three phases of the alternating current network are directed into the electricity meter, taken through by a current collection system and out again from the electricity meter. An electronic circuit in the electricity meter collects the currents of the three current collection systems and calculates the energy consumed from the strength of the current and the position of the phase, as is for example known from U.S. Pat. No. 4,887,028.

The most economical manufacture at present of a magnetic component for high output current transformers exists in the manufacture of ring cores, in particular in ring band cores, and the winding of the isolated and/or encapsulated cores with the corresponding secondary winding based on magnet wire. Suitable cores are known for example from the EP 1 131 830 and EP 1 129 459. WP 1 114 429 describes current transformers for such purposes.

One possibility of the constructive structure of a current transformer exists in that the size of the current transformer is so chosen that it is possible to insert a current bar of, for example, the size of 19×2.5 mm right through the inner bore of the current transformer.

An optimizing exists in that the area of the current bars, on which the current transformer is to be placed, is given a round cross-section. In this manner the inner bore of the current transformer can become smaller, and as a consequence of this a smaller ring band core can be used, whereby this is then, determined by the method employed, correspondingly more economical. Even if the same use is made of soft magnetic band material and with the same winding time for the core, the steps of the process of a heat treatment and a layering are more economical, the smaller the diameter of the core. The manufacture of a current bar suitable for this takes place through the provision of a U-formed conductor structure with various line sections. A central constituent section of the circuit with a round cross-section serves as the element of the current transformer for insertion in the corresponding opening in the core. Two line connections with rectangular cross-sections serve to connect the conductors in the form of well-known plug-and-socket connections. The order structure of conductors thus consists of three metal parts with cross-sections at variance with each other, whereby both the ends of the round conductor are to be fixed to the flattened surfaces of the rectangular line connections.

Well known for the purposes of fixing is the connection by means of resistance point welding or hard soldering. Both methods require however costly and elaborate method technology as well as a high degree of application of energy for each of the connection points to be made. A particular difficulty is to be seen in the checking of the connection points, carried out simultaneously with the installation process, for the purposes of ensuring the quality of the order structure of the conductors, since the welding in particular, in the sense of DIN ISO 9001, is to be categorized as a so-called special process, in the manner in which this is well known from the publication "Fügetechnik, Schweistechnik" ["Joining Technology, Welding Technology"], DVS Publishers, ISBN 3-87155-786-2; page 328, 2004. Particularly critical are in this case the effects of oxide layers on the corresponding connective parts, the wear and tear of the electrodes as well as the non-option of a definitive, for example optical or electrical checking of the connection.

The connection of such a conductor structure order of three elements with cross-sections respectively at variance with each other at the connection points is supposed to enable a long lifetime of approx. 10-15 years for example, so that the process of the installation of the order structure of the conductors is to be carried out in a very sure manner. For reasons of electrical conductivity, corresponding current bars and/or order structures of the conductors are predominantly constructed out of copper material. Problems arise in this case both in the case of hard soldering as well as in the case of welding in particular from the heating at the time of the creation of the connection points, as the heat is conducted by the conductor to the current transformer and can damage it.

The so-called cold press welding is generally known for the joining of tow metals, something which is for example described in the overview of the status and developmental tendencies of cold press welding, J. Ruge, H. Preis and K. Thomas, Braunschweig, DVS Report, volume 139, "Abbrennstumpfschweissen und Reibschweissen mit verwandten Verfahren" ["Flash welding and friction welding with related methods"], page 25, 1991. From the research report "Untersuchung zum ultraschall-gestützten KaltpressSchweissen für Anwendungen in der Kleinteilfertigung" ["Investigation of ultra-sound supported cold press welding for application in the manufacture of small parts"], Institut fur Schweisstechnik TU [Institute of Welding Technology, Technical University] Braunschweig, Institut für Füge- und Strahltechnik [Institute of Joining- and Jet Technology] Otto von Guericke, University of Magdeburg, AiF no. 12494 BG/4 Jun. 1, 2000/Sep. 30, 2002 and from "Informationen und Anwedungshinweise zur Tox-Verbindungstechnik" ["Information and application details for the Tox Joining Technology"] of the firm Tox-Pressotechnik GmbH & Co. KG, Weingarten, a clinching is known as a kind of clinch sealing of two metallic bodies.

SUMMARY

An inductive component in particular for current collection equipment as well as a method for the manufacture of such an inductive component can be proposed, which provides a simple manufacturing method with the secure joining of, and as little pressure as possible on further components.

According to an embodiment, an inductive component may comprise a conductor with non-rectangular cross-section for channeling a current, at least one flat line connection for supplying or discharging of a current to and/or from the conductor, wherein the conductor and the line connection are connected to each other in the region of a constituent section of the circuit of the conductor through the construction of a conductor structured order, and wherein the conductor displays a flattened cross-section in the region of the constituent section of the circuit and a flat surface of the constituent section of the circuit of the conductor is joined to a flat surface of the line connection.

According to a further embodiment, a method for the manufacture of an inductive component, may comprise the steps of: connecting a conductor with a non-rectangular cross-section with a flattened line connection, flattening the cross-section of the conductor in a constituent section of the circuit of the conductor, and joining the flattened constituent section of the circuit of the conductor with the line connection.

BRIEF DESCRIPTION OF THE DRAWINGS

The invention is described in more detail in the following section on the basis of the exemplary versions shown in the figures of the illustration. It shows.

DETAILED DESCRIPTION

Figure 1:
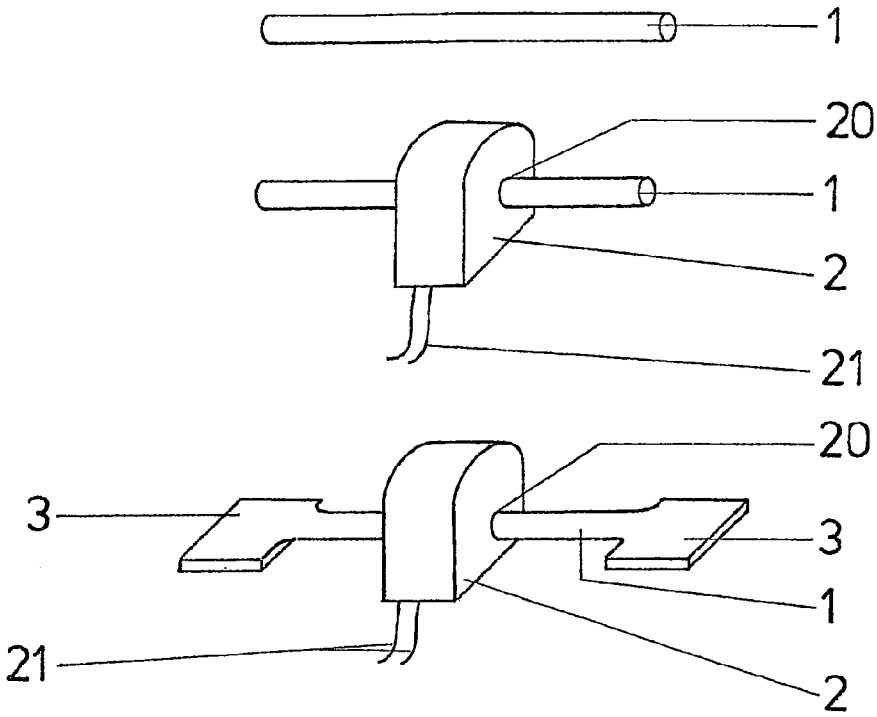
FIG. 1 individual manufacturing stages in the manufacture of an inductive component in accordance with an embodiment.

In accordance with this an inductive component is envisaged with a conductor with a non-rectangular cross-section for the purposes of conducting a current to be collected or measured, at least one flat line connection for the supply and discharge of the current to be collected to and from the conductor respectively, whereby the conductor and the line connection are connected with each other in the region of a constituent section of the circuit of the conductor with the formation of a structured order of conductors, and whereby the conductor displays a flattened, in particular rectangular cross-section in the region of the constituent section of the circuit and a flat surface of the constituent section of the circuit of the conductor is connected to a flat surface of the line connection. In the case of application in a magnetic module with an opening the conductor is led through the opening.

According to an embodiment, a method for the manufacture of a structured order of conductors for an inductive component, in particular to be applied in current collection equipment, comprises the steps of connecting a conductor with a non-rectangular cross-section to a flat line connection, wherein in the case of the conductor the cross-section is flattened in a constituent section of the circuit of the conductor (in particular with a rectangular cross-section), and the flattened constituent section of the circuit of the conductor is connected to the line connection.

In addition to this an inductive component can be envisaged, in the case of which the cross-section of the conductor is formed on the other side of the constituent section of the circuit with a curved, in particular round outer contour, in particular an oval or a round cross-section form.

The inductive component can be manufactured in a version with two constituent sections of the circuit on the conductor for the purposes of joining the conductor with two line connections.

In addition to this the connection can be designed with press joining, in particular cold press joining.

It is advantageous in particular if the press joining in this case is designed as clinch joining.

An inductive component can also be envisaged in the case of which the press joining between the constituent section of the circuit and the line connection is doubly constructed.

Furthermore the conductor and the line connection(s) can be designed as metal parts made out of copper or a copper alloy.

The inductive component in accordance with an embodiment can for example be a magnetic module for the purposes of the collection of the current. The magnetic module can be designed as a current transformer and/or transformer.

In particular a current transformer displays preferably a ring core. The ring core is preferably constructed as a ring band core. Advantageously the ring core is constructed out of an amorphous or nano-crystalline alloy.

The conductor can have a distortion, in particular a grouting under pressure for the purposes of fixing and/or alignment in an opening of the current transformer vis-à-vis the other cross-section.

The contact points can be freed and cleansed of, and/or plasma-activated from metal oxides in the region of the constituent section of the circuit and/or the line connection. Advantageous is also current collection equipment, in the case of which the conductor, the constituent section of the circuit and/or the line connection are annealed by means of heat treatment.

The joining is preferably carried out as press joining with the help of clinching technology. Preferably a method is applied, in the case of which the contact points are freed of metal oxides before joining by means of chemical treatment, in particular etching. The contact points can in such cases be cleansed on their surfaces and/or activated by means of plasma treatment before being joined. Advantageous is also a method in which the conductor, the constituent section of the circuit and/or line connection of which is and/or are annealed by means of heat treatment before the joining.

The order structure of the conductors thus represents a cost-optimized and long-term stable construction of conductor bars. In a simple manner the conductor with the non-rectangular cross-section, in particular with a round or almost round cross-section on the one hand and on the other hand with at least one line connection with a flat surface, in particular a rectangular cross-section are joined to one another, whereby this displays a stable connection with a long lifetime. In particular in the case of press joining without the use of heat through soldering or welding for example, there is the particular advantage that no heat is transferred via the conductor to neighboring components of the ring core and such like parts. The second connection between the conductor and a second line connection can for example be made in the opening of the current transformer and/or ring core before the use of the conductor, so that in the final analysis if necessary only one connection of this kind is necessary.

Through the flattening of the ends of a round rod as a conductor, on which the current transformer sits, flat areas are created, which are joined after the flat connective lugs are laid one on top of the other through a process of cold press joining, e.g. clinching, in a long-lasting manner and with the least possible transfer resistance. Naturally the flattening of the conductor must not necessarily take place at the ends; it can also take place in another area neighboring the ring core and/or the current transformer.

In particular a cold welding process in connection with riveted joining requires a high degree of flexibility, so that it is advantageous to use a soft metal such as, for example, copper or a copper alloy. Through a corresponding pre-treatment of the corresponding connective part, i.e. the conductor and the line connection(s), a cold welding joining result with respect to the electrical characteristics, for example, a minimal transfer resistance and gas impermeability can be further improved. The so-called cold press welding offers the advantage of a welding method, in the case of which a joining takes place completely, without added external thermal energy, solely through the force of pressure. Clinching represents a riveting process, which advantageously manages without riveting, i.e. foreign materials, in that the basic material of one of the involved corresponding parts, for example the conductor, is pressed deep into an emerging cavity in the other corresponding part, for example the line connection, whereby a mushroom-shaped undercut is formed corresponding to the form of a press stamp or seal and a mold or cavity, so that a form and force fitted joining is achieved.

There are a variety of advantages through the joining technology and/or the construction of the structured order of the conductors. Along with good electrical characteristics, a mechanically very robust connection is achieved. A simple manufacturing technology enables plant investments of only 30-50% as compared to the corresponding welding/hard soldering technology. A simple and economical maintenance of the manufacturing plant as compared to the welding/hard soldering technology is possible. As opposed to the welding/hard soldering technology no heating of the metal parts takes place if a cold welding joining process is used, so that no separate cooling process is necessary in order to protect, for example, a plastic coating of a current transformer. Vapors, sparks or splinters are avoided. Quality control is possible through the checking and control of simple mechanical dimensions, for example the thickness of in the formed "rivet". Furthermore the energy costs per connection point using this manufacturing method are three to five times less than in the case of the welding/hard soldering technology. In a comparison of the point welding technology and the clinching technology the costs per connection point are more economical in a proportion of 5:1 in the case of clinching being used, even if the investment costs, the running costs and the cost of tools are taken into consideration.

Since the structured order of the conductors serves to transfer an electrical current, a heating up of the order of conductors through the current flow, in particular in the region of the constituent sections of the circuit of the conductor, is to be taken into consideration. The electrical resistance of a typical U-formed current bar amounts to approximately 100 μohms. With a current of approximately 200 A, a loss output of 4 W in the unit arises in accordance with $Pv=I^2\times R$, which results in the heating up. In such a case, care must be taken that the points of connection do not represent a constriction of the conductive cross-section. In the case of a bad connection the temperature there, determined by the higher potential difference, clearly rises over the level of the remaining connective parts and accelerates the damage and/or the wearing out of the contact point. In such a case an increase of the transfer resistance can result. This is a cumulative process, which can end in a further increase in temperatures and finally in the breakdown of the connection point. In the case of a welded or, in particular, a soldered connection, this can lead to a partial or complete melt down of the connection point through overheating. Whether soldering or welding bridges are stable in the long term, is something which is very unsure as a rule. An electric arc arising at the last stage of such a breakdown scenario can result in the complete interruption of the electrical connection. The requirement for the connection point therefore of a low-ohm connection with simultaneously high mechanical resistance has to be fulfilled, so that the transfer resistance does not perceptibly increase through shocks and abrasion, vibration or impacts at the time of assembly or of later use.

It is advantageous that the current collection equipment in accordance with an embodiment and/or the described manufacture method offers a low ohm connection with simultaneously high mechanical resistance, which, even in the case of heating caused during running when a clinching process is employed, still enables, despite this, a durable connection.

FIG. 1 shows components, in various stages of manufacture, of current collection equipment, which are described in the following section as representative and exemplary for inductive components in accordance with an embodiment. At the top a conductor 1 is shown, which, as shown in the middle, is inserted through an opening 20 of a current transformer 2. The conductor displays a non-rectangular, in particular a round cross-section. For the purposes of anchoring within the opening 20 of the current transformer 2, for example, the cross-section of the conductor 1 in this region can also be slightly deformed, for example, slightly flattened or oval instead of circular, in order to achieve a clamping interface contact with the wall of the opening 20. Instead of a circular conductor 1 however, conductors with other forms of cross-sections than circular forms of cross-sections can also in principle be used. In principle, for example, cross-sections in the form of an octet, quadrate or if necessary, a triangle with wavy or serrated outer dimensions are usable, which clearly deviate from a flat rectangular form.

After the insertion of the conductor 1 through the opening 20 of the current transformer 2, the end of the conductor 1 inserted through the opening 20 of the current transformer 2 is flattened for the purposes of the construction of the constituent section of the circuit 3. In an especially simple manner, the flattening takes place through a process of crushing, something which, in particular in the case of a conductor 1 made of copper or a copper alloy, is especially easily possible. In the version shown, the constituent section of the circuit 3 of the conductor 1 displays an essentially rectangular cross-section. Advantageous to realize are in principle however also other cross-sections, which display a flattening on one side, for example also a flattening through material loss.

Figure 2:
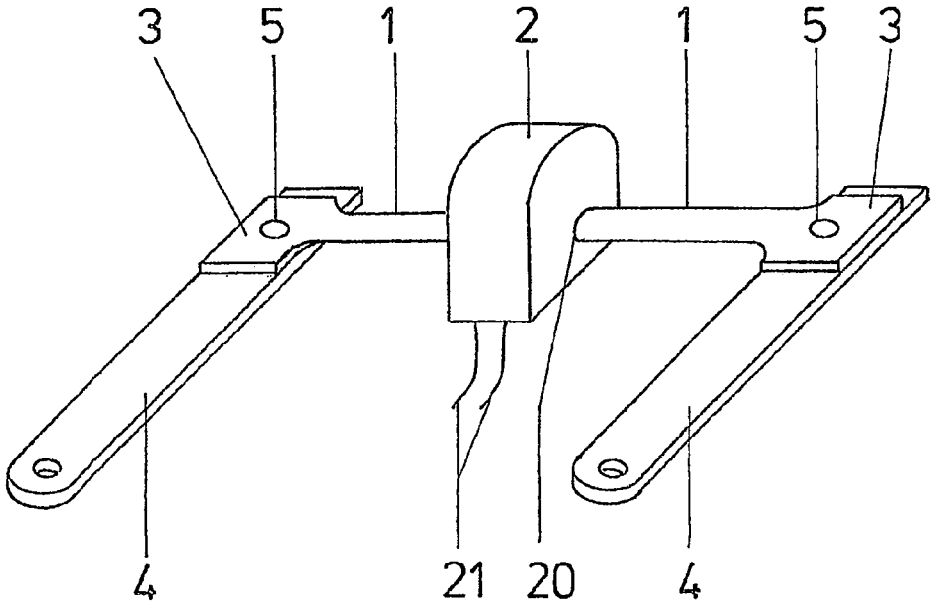
FIG. 2 assembled components of an inductive component in accordance with a first version.

FIG. 2 shows an end stage of a preferred order structure of conductors from the conductor 1 with constituent sections of the circuit 3 at both ends; from the current transformer 2, through the opening 20 of which the conductor 1 goes through the constituent sections of the circuit 3 belonging to it, and with two line connections 4, which are constructed as oblong, flat insertion rods with a quadrangular or essentially quadrangular cross-section. For the purposes of joining the constituent sections of the circuit 3 with the line connections 4, the flattened constituent sections of the circuit 3 are joined with their flat surface laid on the flat surface of the line connection 4, and joined to each other. The connection can take place in an essentially well known manner, for example also through soldering or welding. Particularly preferred is however also a process of cold joining without the addition of heat by means, for example, of cold press welding and/or clinching.

A current led through both the line connections 4 and the corresponding constituent section of the circuit 3 to the conductor 1 is directed through the opening 20 of the current transformer 2 and is discharged through the second constituent section of the circuit 3 and the second line connection 4. The current directed through the current transformer 2 induces a current flow in the current transformer 2, which is led through conductors 21 of an evaluative circuit for the purposes of the collection of the flowed stream.

Figure 4:
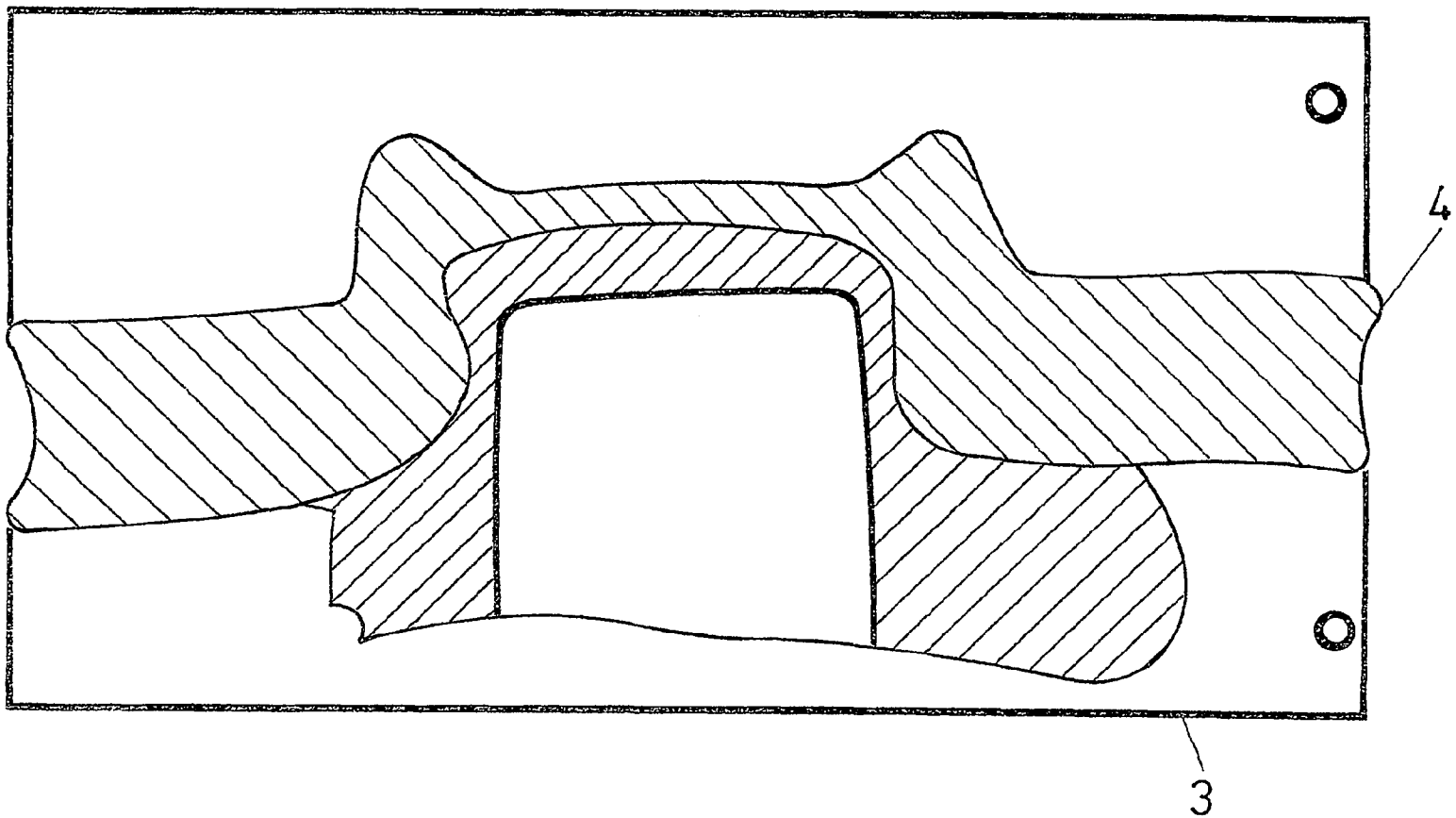
FIG. 4 a cross-section through a clinching point.

In the case of the version in accordance with FIG. 2 there is an order structure of conductors represented, in the case of which both the constituent sections of the circuit 3 of the conductor 1 were produced through pressing from the conductor 1 originally in the form of a round rod. Through pressing, the thickness of the rod is reduced and a plane surface is produced. With the help of a joining technology based on clinching, the ends of the round rod and the rectangular connective lugs, which are formed through the line connection 4, are joined together. Through the severe distortion of in the region of the connection points of the clinching, rivets are formed in the shape of buttons 5, so that by means of a cold welding process a mechanically stable joining and a good electrical contact are produced for a safe and secure current flow. FIG. 4 represents a cross-section through an exemplary connection produced by means of clinching of a constituent section of the circuit 3 and a line connection 4. Through the suitable choice of a stamp, the material pressed into the line connection 4 by the constituent section of the circuit 3 takes the form of a mushroom shaped cross-section and forms an undercut for the purposes of creating a mechanically high degree of stability in the form of a rivet. Represented is the case of an 8 mm wide riveting by means of clinching, whereby however also other dimensions corresponding to the need in question can be selected.

In the case of a clinching point of the exemplary size of 8 mm between two copper parts with the thickness of 2.4 mm each, a shearing resistance resulted in the first attempts of more than 1600 N and a head course resistance of more than 1500 N.

Figure 3:
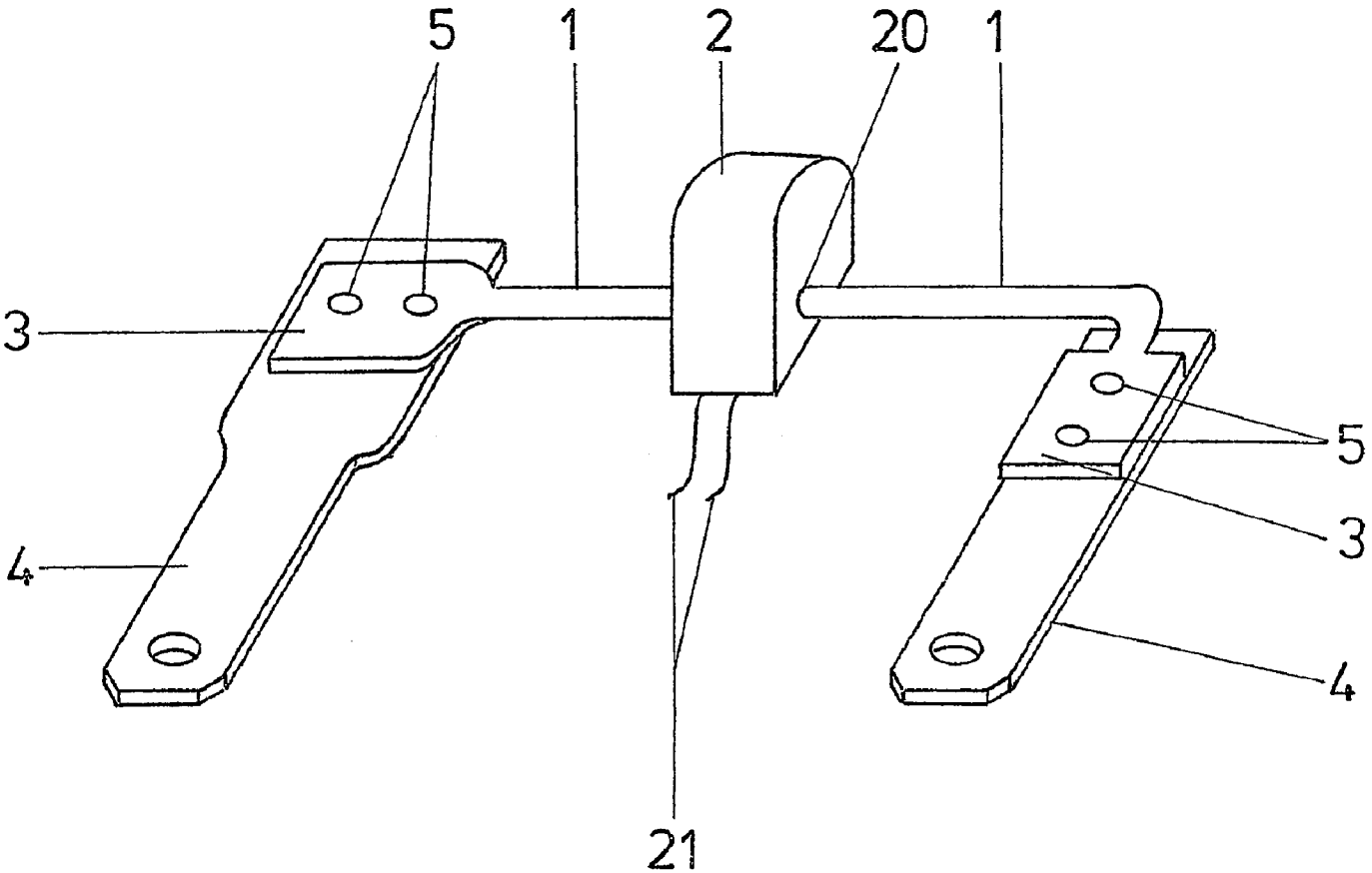
FIG. 3 assembled components of an inductive component in accordance with a second version.

FIG. 2 shows a version with one clinching point 5 each for the purposes of joining the corresponding constituent section of the circuit 3 with the neighboring line connection 4. FIG. 3 shows a further version of an order structure of conductors with one conductor 1 as well, the flattened constituent sections of the circuit 3 are each joined with a line connection 4, whereby for the connection two clinching points each are used. Through this there arises a protection against distortion of the conductor 1 with respect to both the line connections. What is also sketched out is that, apart from this, the conductor 1 must not necessarily lead in a straight line from one constituent section of the circuit 3 to the other constituent section of the circuit 3, it can also be curved.

Figure 5:
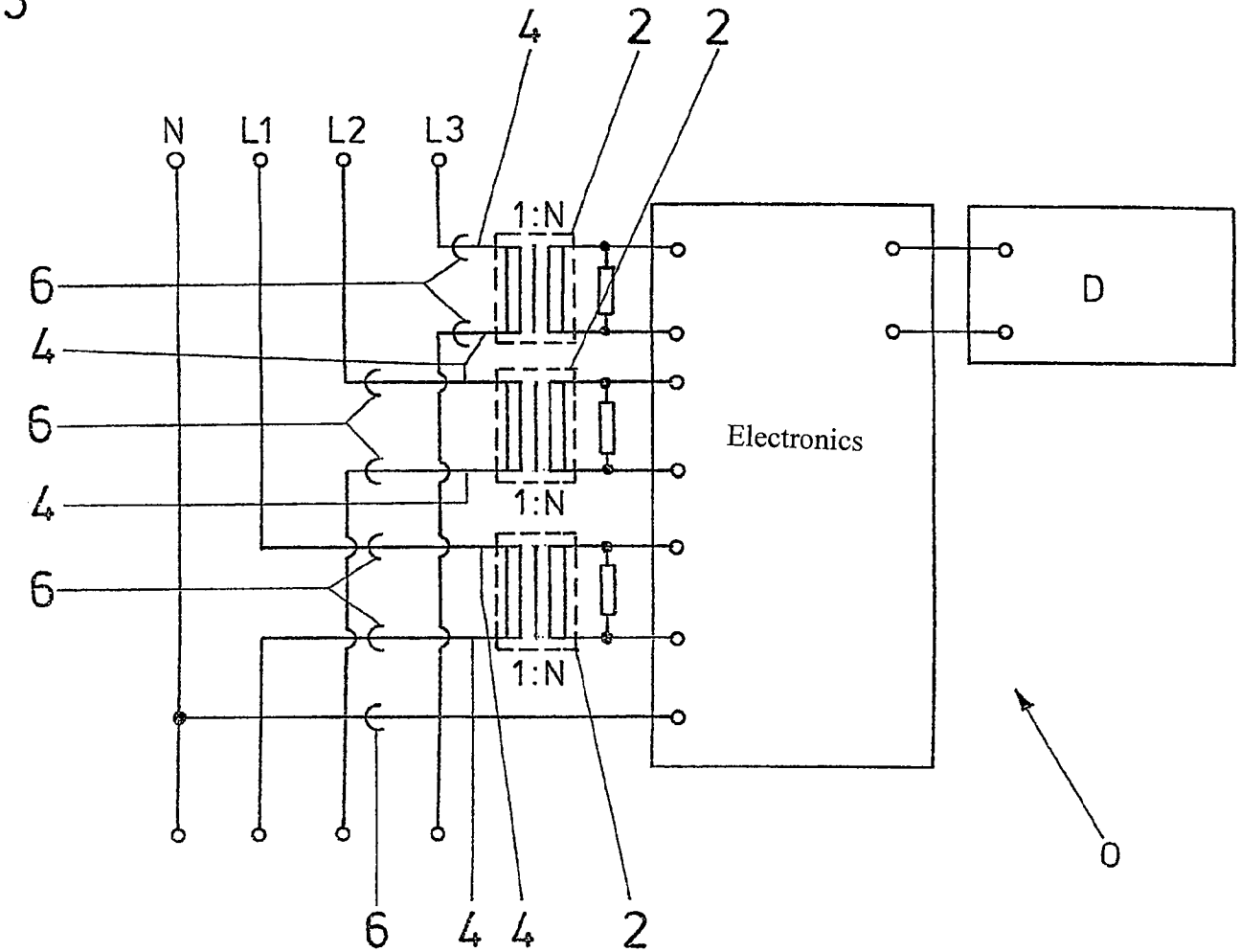
FIG. 5 a circuit arrangement known in itself to be exemplary, in which such components can be used.

FIG. 5 shows an exemplary arrangement of circuits of current collection equipment 0 for the measurement of a flow of current through three conductors L1, L2 and L3. In the usual manner a corresponding cable has also a neutral conductor N. The three conductors L1, L2 and L3 are interrupted and each end in a plug contact 6 for the purposes of the plugging-in of a contact pin in the form of the line connection 4. Each one of the conductors L1, L2, L3 are thus matched to two plug contact elements 6 in the form of plug sockets, in which both the line connections 4 of the order structure of conductors are plugged-in in accordance with FIG. 2 or FIG. 3 for example. The conductor 1 joining both the line connections 4 via the constituent sections of the circuit 3 leads through the corresponding opening of a current transformer 2, which can be constructed for example with the structure in accordance with FIG. 2 or FIG. 3.

For example three current transformers 2 with an order structure of conductors of this kind each, are arranged and fixed to a circuit board with an electronic system for the evaluation and/or current collection. Normally the electronic system is accommodated in a housing, out of which a corresponding number of six such line connections 4 as contact pine for plugging-into corresponding plug contact sockets 6 as well as a further line connection as contact pin for a connection with the neutral conductor N extend out. Normally such an electronic system also displays one or several output units for the display of the collected current quantity. For example in the case of the output equipment it is a case of a display unit D. On the display unit D or another external interface, the current quantities collected by means of signal processing and if necessary analog-/digital transformers in the electronic system are displayed.

In the case of the represented principle circuit diagram of an electronic electricity meter as current collection equipment 0 thus an individual voltage signal for an evaluative electronic system is produced and supplied to this with three pluggable current transformers from the three currents by means of a 1:N transformation and via load resistances. After this the display of the calculated energy by means of display equipment follows.

Thus a preferred conductor system is provided, which serves to measure electrical currents and is constructed, in particular, of three metal parts and a current collection system. The conductor system consists in this case of a part more in the middle than the conductor 1, which preferably has a round cross-section and in the case of which, after the mounting of the current transformer 2 as a current collection system, at least one, in particular both of its ends are flattened as the constituent section of the circuit 3. Apart from this the conductor system consists of two further parts in the form of the line connection 4 with a rectangular cross-section for the formation of connective lugs and/or contact pins for a plug-and-socket connection.

The joining of the three parts takes place in particular as a cold press joining for the formation of a mechanically and electrically good connection. A cold press joining is in such a case preferably created twice on each side in order thus to achieve additional securing against distortion or skewing with the simultaneous increase of the connective cross-section. Preferably the current collection system consists of a current transformer acting in a transformative manner. Preferred as a current transformer is a ring core, in particular a ring core constructed as a ring band core from an amorphous or nano-crystalline alloy. The round metal rod forming the conductor 1 preferably possesses in the middle region and/or in the region, which is inserted through the opening 20 of the current transformer 2, a distortion, in particular a slight grouting under pressure, by means of which the current transformer 2, when it is mounted on the conductor 1, is fixed in a desired position and fixed to it.

For improving the connection the contact points are freed with a chemical treatment such as the etching of metallic oxides before the joining, in particular before the clinching process. This is advantageous. The contact points are cleansed and/or activated on the surface before clinching or any other joining process through, for example, a treatment in a plasma. It is also advantageous to anneal the metallic parts before the clinching process through heat treatment.

Although in the exemplary versions cited above reference is made to current collection equipment, optional inductive components, which speak for themselves, such as possibly inductors, transformers and other types of magnetic modules can be constructed and manufactured in accordance with the invention.

What is claimed is:

1. An inductive component comprising a conductor with non-rectangular cross-section for channeling a current, at least one flat line connection for supplying or discharging of a current to and/or from the conductor, wherein the conductor and the line connection are connected to each other in the region of a constituent section of the circuit of the conductor through the construction of a conductor structured order, and wherein the conductor displays a flattened cross-section in the region of the constituent section of the circuit and a flat surface of the constituent section of the circuit of the conductor is joined to a flat surface of the line connection by a cold pressing process in which the material of one of the conductor and the line connection is pressed into an emerging cavity in the other one of the conductor and the line connection to form a mushroom-shaped joining structure.

2. The inductive component according to claim 1, wherein the cross-section of the conductor is formed on the other side of the constituent section of the circuit with a curved external contour.

3. The inductive component according to claim 2, wherein the cross-section of the conductor is formed on the other side of the constituent section of the circuit with a rounded external contour.

4. The inductive component according to claim 2, wherein the cross-section of the conductor is formed on the other side of the constituent section of the circuit with an oval external contour.

5. The inductive component according to claim 1, comprising two constituent sections of the circuit on the conductor for the purposes of connecting the conductor with two line connections.

6. The inductive component according to claim 1, wherein the joining is in the form of a press joining.

7. The inductive component according to claim 1, wherein the joining is in the form of a cold press joining.

8. The inductive component according to claim 6, wherein the press joining is formed as a clinch joint.

9. The inductive component according to claim 6, wherein the press joining between the constituent section of the circuit and the line connection is formed twice.

10. The inductive component according to claim 1, wherein the conductor and the line connection(s) is/are constructed as metallic parts made of copper or a copper alloy.

11. The inductive component according to claim 1, wherein the inductive component displays a magnetic module with an opening, whereby the conductor is led through the opening.

12. The inductive component according to claim 1, wherein the magnetic module is constructed as a transformer.

13. The inductive component according to claim 12, wherein the transformer displays a ring core.

14. The inductive component according to claim 13, wherein the ring core is constructed as a ring band core.

15. The inductive component according to claim 13, wherein the ring core is constructed out of an amorphous or nano-crystalline alloy.

16. The inductive component according to claim 1, wherein the conductor displays a distortion for the purposes of fixing and/or aligning in an opening of the current transformer as opposed to the other cross-section.

17. The inductive component according to claim 16, wherein the distortion is a grouting under pressure.

18. The inductive component according to claim 1, wherein contact points in the region of the constituent section of the circuit and/or of the line connection are freed of metallic oxides, are cleansed and/or plasma-activated.

19. The inductive component according to claim 1, wherein the conductor, the constituent section of the circuit and/or the line connection are annealed by means of heat treatment.

20. The inductive component according to claim 1, wherein the conductor displays a rectangular cross-section in its flattened section.

* * * * *